US005367848A

United States Patent [19]

McConnohie

[11] Patent Number: 5,367,848

[45] Date of Patent: Nov. 29, 1994

[54] BRACKET

[75] Inventor: Duane V. McConnohie, Tampa, Fla.

[73] Assignee: Roof Hugger Inc., Oldsmar, Fla.

[21] Appl. No.: 171,830

[22] Filed: Mar. 10, 1994

Related U.S. Application Data

[63] Continuation of Ser. No. 524,277, May 16, 1990, abandoned.

[51] Int. Cl.[5] ..... E04B 1/20

[52] U.S. Cl. ..... 52/336; 52/334

[58] Field of Search ..... 52/336, 334, 335, 327, 52/410, 478, 479, 508, 747, 748, DIG. 15, 730.6

[56] References Cited

U.S. PATENT DOCUMENTS 4,494,343 1/1985 Berpy et al. ..... 52/410 X

*Primary Examiner*—Carl D. Friedman
*Assistant Examiner*—Creighton Smith

[57] ABSTRACT

A bracket for use in the after market of metal clad buildings to facilitate attachment of new roof or wall panels of any desired profile, directly over existing ribbed or fluted panels of various configurations. Commonly known in the trades as a sub purlin or sub girt. Generally a one piece Z shaped metal bracket with opposed top and bottom flanges in a parallel plane. The bottom flange and adjacent lower portion of the web contain a series of notches that allow the bracket to nest onto and over existing ribbed roof or wall panels. The top flange is automatically in position, lying flat and continuous, to receive and attach the new panels thereto. The solid portion of lower flange is preferred to be positioned directly above the underlying substructural support system members of the existing building to assure a structurally sound attachment of bracket to the building. Pre-punched holes in the solid portion of lower flange dictate required location, number and size of fasteners to be inserted through lower rib surface of existing panel into substructural system members. The bracket and new panel installation require only standard tools, fasteners and technique as normal to the trade to complete the procedure.

4 Claims, 1 Drawing Sheet

BRACKET

This application is a continuation of application Ser. No. 07/524,277, filed May 16,1990, now abandoned.

BACKGROUND: FIELD OF INVENTION

The present invention relates generally to metal building structures: Specifically to the retro-fitting of new roof and/or wall panels directly over existing fluted or ribbed roof and wall panels.

1. Prior Art

There is no prior art to be found directly related toward addressing the several problems in retro-fitting of new roof or wall panels for the specialty metal buildings field.

This field specifically refers to lightweight steel structures and particularly to the ribbed panels of roof and wails. The panels are generally of steel and noted for their series of parallel, alternating, formed, ribs and valleys to stiffen the thin materials to resist horizontal and vertical applied loads.

2. Description of the Prior Art

1. Simpson, U.S. Pat. No. 4,534,148, Aug. 13, 1985, discloses a system of light gauge metal channels forming a series of graduating heights of stanchions above a flat roofed structure to achieve an elevated pitched angle of new roof to facilitate drainage, with no relevance to the present invention's purpose or physical shape.

2. Carsons, U.S. Pat. No. 1,396,727, Nov. 15, 1921, discloses a patent for pre-formed running boards for automobiles, again, still further from any relevance to the present invention.

3. Fork, U.S. Pat. No. 3,721,051, Oct. 18, 1967, Forks disclosure is limited to creating hollow raceways for imbedded conduit or wire in a poured concrete floor system. No conceivable modification could suffice for the purpose of the present invention.

4. Folley, U.S. Pat. No. 3,820,295, Sep. 11, 1972, discloses a system for use as a stiffener for end laps and splices of metal wall and roof panels to add support to floor deck systems and enable longer spans of roof and wall sheets. It is not of any similar nature to the applicants invention and totally impractical for use for replacement of new roof or wall panels over existing ribbed panels. There is no sign of intent of use other than as a stiffener.

5. Murphy, U.S. Pat. No. 3,634,984, Feb. 12, 1970, discloses only the forming of short pieces of metal to fit the wall corrugations at the parapet coping flashing. It can be readily seen that this could not be modified into a subpurlin structural member. Its purpose is as a bird block to close off the open flutes. Such function is now accomplished by pre-formed, foam neoprene sponge closures.

6. Virgil Morton, U.S. Pat. No. 4,894,967, Jan. 23, 1990, discloses a system which acts as a fixed shear resistance element for floors or poured lightweight concrete roofs which is rigidly welded or bolted to the underlying support beam. Both ends of the fluted deck butt against the shear angle and are welded to the top and bottom flange as in his FIG. 10, sheet 3. This drawing clearly shows the intent, the multiple welds and the rigidity it produces, all of which require a heavy steel section which, in itself disqualifies it from use as applicants invention is intended.

The Morton patent configuration, welded attachment, weight of materials, and sole intent of rigidity render it totally unuseable for the purpose of the present invention. Further, Morton shows no conception of replacement of roof and wall panels over existing materials nor is his invention relative in any manner to the huge field of pre-engineered, prefabricated, lightweight, metal buildings.

From the reference art in total and the Morton patent in particular, applicant has found nothing of relevance to the intention of present application. Nothing has been developed to address the specific critical needs which are clarified in the following descriptions.

Accordingly, it is the object of the present invention to provide a product and means to the metal building industry to enable retro fitting of new roof or wall panels over existing roof or wall panels without the necessity of removal of existing panels. Such product and means to also meet criteria demanded by building codes.

A metal building is a lightweight structure consisting of vertical steel columns, steel rafter beams bolted to the vertical columns and generally spaced from 20 to 30 feet apart. The rafter beams are generally sloped to provide positive drainage.

Spanning the columns and rafter beams at sidewalls and roof are a series of light gauge sub-structural "z" or "c" sections bolted to the columns and rafter beams. These are generally on 4' to 5' spacing and run perpendicular to the columns and rafter beams, commonly known in the trade as purlins for roof support and girts for sidewall support.

Covering the structural system are ribbed, fluted or profiled panels with alternating higher ribs and flat valleys or pans generally with high rib being 6" to 24" on center and valleys being 4" to 18" across the flat and of generally 26 gauge or 24 gauge sheet metal, creating a structural diaphragm when fastened to the substructural system.

Such higher rib surface's lie substantially in an upper plane and the bottom valley or pan surfaces lie substantially in a lower plane spaced apart from the upper plane. The alternating top and bottom surfaces are interconnected by a series of webs extending parallel to the longitudinal axis of the formed panel diaphragm.

There are an infinite variety of shapes of such configurations commercially available. For simple reference refer to the top surface as being the top plane of the higher rib and base surface as being the lower plane of the low rib. The web being the connecting form of the two.

The panels are generally attached to the aforesaid sub-structural members with generally a series of threaded screws, generally 12" or less on center for the entire building length. Standing seam type roofing is attached to the sub-structural members by means of clips mounted on the sub-structural members.

The design of metal building structures optimizes minimum weight materials to work in unison in meeting the building code requirements for wind, snow, ice and live loading for the many geographical location's exposure to the elements.

In achieving that criteria, each component is engineered to meet the requirements of the codes.

In re-roofing of such structures, extreme attention is given to limiting imposition of further dead loads on the original structural design and yet to resist the full wind uplift requirements of multiple building codes.

Additionally, the original structural design relies on the rotation or flexural movement of the Z shaped substructural purlins to accommodate the thermal expansion and contraction of the metal roof panels and the sheer action of the roof panel diaphragm in gusting wind conditions.

Applicants invention takes each of these concerns into full consideration and acts to duplicate and mimic those concerns as they were designed and approved in the original structure.

Accordingly, the reader or those skilled in the art will readily see the many advantages the present invention brings to the retrofitting of roof and walls of metal buildings.

Objects and Advantages

Accordingly, objects of the present invention are as follows:

(a) To furnish a bracket to attach new roof or wall panels over existing configured, fluted or profiled panels and achieve a structurally sound connection.

(b) To furnish a lightweight bracket with sufficient cross section strength to meet mandated forces of various building codes without excessive additional weight on the existing building structural system.

(c) To furnish a bracket having a range of adaptations, versatility and advantages while remaining simple and economical for its purposes.

Advantages of the present invention are as follows:

(a) The bracket absorbs thermal expansion and contraction and wind shear movements of the attached new panels.

(b) A bracket having a configured lower portion of web and bottom flange with a series of notches custom formed to fit over the profile of existing panels to be covered, the essential nesting factor.

(c) A bracket formed to nest onto tile existing configured panels to achieve an efficient and proper connection to the existing panels or through the existing panel and into the underlying sub-structural system.

(d) A bracket having pre punched holes in the solid portion of the lower flange to assure proper location, amount and size of fasteners and to prevent bottom flange material from riding up the fastener shank during installation resulting in an inadequate connection.

(e) A bracket in which the vertical web height may be varied to achieve a desired height above the existing panel surface to accommodate various thicknesses and types of insulation or utilities which may be installed between the two panel diaphragms.

(f) A bracket that requires only standard and available tools, fasteners, and techniques for installation of both the bracket and the new panels, resulting in a high degree of efficiency and economy.

(g) A bracket made from corrosion resistant material.

(h) A bracket having similar characteristics of shape, material and fastenings as in the original structure to facilitate building code and permit acceptance.

(i) A bracket configured to nest onto existing profile and thus achieve absolute minimum roof height change or panel separation space to minimize racking and shear under wind loading conditions.

(j) A bracket of light gauge material that is easily adaptable to be configured to match the infinite variety of existing and future profiles.

(k) The brackets light weight to required strength ratio is attained by removal of only the minimum amount of lower flange and web material necessary to achieve the nesting posture onto the existing panel configuration. This is accomplished by custom forming the nesting voids to the specific profile which is submitted with the order to manufacture.

SUMMARY, RAMIFICATIONS, AND SCOPE

The present invention, of a bracket, sub-purlin, or sub-girt is designed to fill a critical need pertaining to the metal buildings industry. That need is a lack of efficient and structurally sound means of attaching new configured, fluted or standing seam roof or wall panels over existing configured panels, reducing or eliminating the necessity of removing either the existing roof or wall materials or its fasteners.

Such need is fulfilled specifically as follows: A bracket, a portion of which lower flange and web sections are notched to form a series of voids configured to nest onto the existing panel configuration it is to be applied over. The top opposed flange section remains flat to receive the new materials. A web connects top and bottom flanges.

A bracket with configured lower flange and web section that nests in close proximity to the underlying substructural system so that a strong and proper connection to the structure can be readily achieved.

A bracket in which the vertical web may vary in height to accommodate additional insulation, utilities or other accessories in the space between the two panels.

A bracket with upper flange of ample width and strength to receive various means of attachment of the new panels.

A bracket with pre-punched holes in the solid portion of the lower flange to properly pre-locate fasteners and prevent the lower flange from riding up on the fastener shank during installation which can result in an inadequate connection.

A bracket versatile and adaptable to be readily configured to the many variations of panel profiles now existing in the field.

A flexible bracket shaped to absorb distortion forces of thermal expansion and contraction of the panels and their movement resulting from wind forces or seismic disturbance.

A light weight bracket to minimize additional dead loads on an existing roof design, yet maintaining flexural and tensile strength to resist the forces mandated by building codes.

A bracket requiring only standard fasteners, tools and techniques for installation to assure maximum economy and efficiency.

A bracket which achieves an absolute minimum height rise in the new roof panels above existing roof panels to minimize racking and shear between the two separated rigid diaphragms when under stress of wind loads.

A bracket which fills all the above critical needs and yet remains simple and economical for its purpose.

The invention, a bracket, sub purlin, or sub girt, trade name ROOF HUGGER TM does accomplish the above functions and satisfies the need for such a device in the rapidly growing field of retrofitting of metal building roofs and walls.

Although the summary description above contains many specificities, these should not be construed as limiting the scope of the invention but as merely providing illustrations of some of the presently preferred embodiments of this invention. For example, multiple materials may be utilized: multiple pieces may be fabricated, then assembled to produce a similar shape.

Various modifications and changes may be made by those skilled in the art without departing from the true scope and spirit of the invention as defined by the appended claims. Thus the scope of the invention should be determined by the claims and their legal equivalents rather than by the examples given.

BRIEF DESCRIPTION OF THE DRAWINGS

Figure 1:
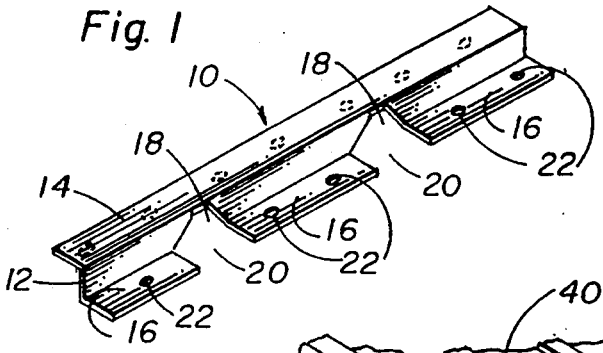
Figure 2:
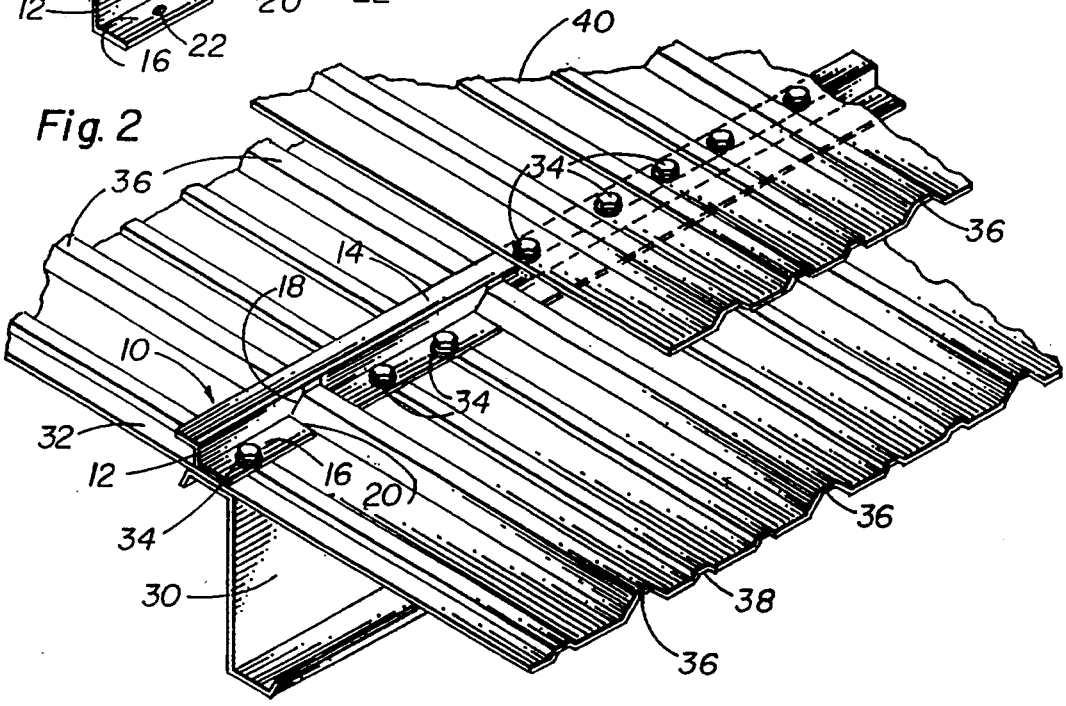
Figure 3:
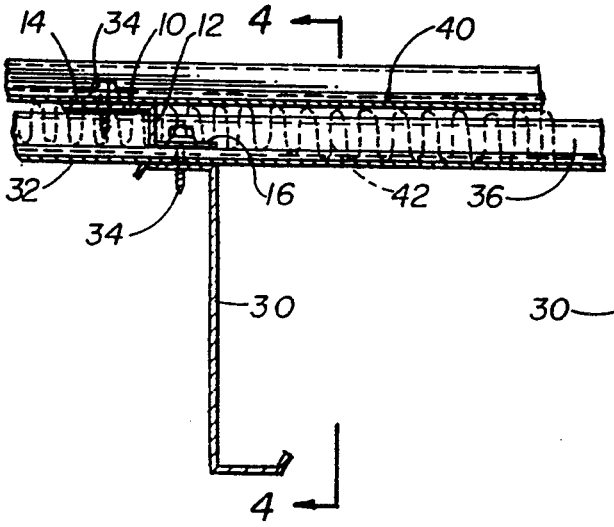
Figure 4:
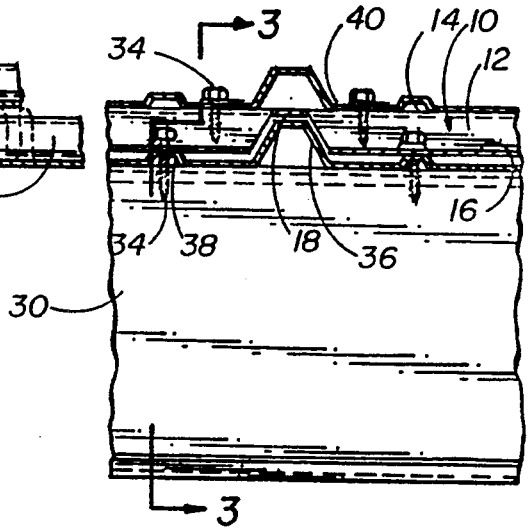

FIG. I
(10) The bracket
(12) Vertical web
(14) Top planar flange
(16) Lower planar flange opposed
(18) Vertical web portion of void
(20) Matching lower planar flange void
(22) Optional attachment apertures
FIG. II
(30) Existing structural purlin
(32) Existing ribbed panels
(34) Fasteners
(36) High rib of existing panel
(38) Pan or valley section of existing panel
(40) New roof or wall panels
FIG. III
(42) Optional insulation
(30) Existing structural purlin
(32) Existing ribbed panel
(10) Bracket
(34) Fasteners
(40) New ribbed panels
FIG. IV
(30) Existing purlin
(36) High rib of existing panel
(38) Pan rib of existing panel
(34) Fastener
(18) Vertical web portion of void
(40) New ribbed panels
(10) Bracket
(12) Vertical web
(14) Continuous upper flange
(16) Lower planar flange

DETAILED DESCRIPTION OF THE PREFERRED EMBODIMENTS

FIG. I is an isometric view of a Z section bracket (10) specially formed and notched for use in retro-fit, re-roofing or re-walling over existing ribbed roofing or wall panels, generally formed of steel.

Top planar flange (14), vertical web (12), lower opposed planar flange (16), vertical web formed void (18), matching lower planar flange formed void (20), optional attachment apertures (22).

FIG. II is a composite drawing revealing the existing building's sub-structural purlin (30), the existing ribbed roof panels (32). Bracket sub-purlin in place (10). Fasteners (34) in place to attach bracket (10) to structural system. New roofing panel (40) attached to the upper horizontal flange (14) of bracket (10) with fasteners (34).

FIG. III depicts longitudinal cross section of existing substructural purlin (30) existing ribbed panel (32) bracket (10), fasteners (34), new ribbed panels (40) and optional insulation (42) shown by dotted lines in loops.

FIG. IV depicts transverse section of assembly of existing sub structural purlin (30), existing roofing panel high rib (36), bracket (10) with its vertical web (12), continuous upper planar flange (14), and lower planar flange (16). Clearly revealed is the form fitting nesting essential of the bracket design.

The inventor has shown herein that he has carefully considered the many special needs of attachment systems for the retro-fitting of new roof and wall panels directly over existing ribbed panels which have not been addressed in any of the available prior art. (A) Light weight, (B) Nesting configuration, (C) Common use fastening system, (D) Z shape for rotation accommodation of expansion and contraction, and (E) Essential duplication of the buildings original structural design intent to facilitate building code approvals.

The above essentials comprise the bracket to be a new and vastly superior retro-fit invention of significant value to the trades.

Various modifications and changes may be made by those skilled in the art without departing from the true spirit and scope of the invention as defined by the appended claims.

While the present invention has been described with reference to several preferred embodiments thereof, the description is for illustrative purposes only and is not to be construed as limiting the scope of the invention.

I claim:

1. A system for supporting and attaching new roof or wall panels over existing roof or wall panels, containing alternating upper and lower ribs profile, comprising:

said existing panels having a base surface connected by raised ribs to a top surface, said top surface being the uppermost or outermost surface away from said base surface, said base surface attaches to a building's roof or wall substructural support members;

a bracket spanning generally co-level with and perpendicular to the ribs of said existing panels, said brackets having a top flange, a web, a base flange, a width, and a height, said base and said web configured to generally nest over said base surface, said raised ribs and said top surface of said existing panels, said top flange generally flat to receive said new roof or wall panels, said width sufficient to receive fastening means, said height a distance sufficient and variable to allow said new panels to be located a correct distance above said top surface to allow desired utilities or thickness of insulation to be placed between said existing panels and said new panels;

upon nesting said bracket over said existing panels said bracket is attached to said existing panels with fastening means, and said new panels are attached to said top flange of said bracket with fastening means.

2. A system as defined in claim 1, wherein said bracket is Z shaped, the lower flange of said bracket attaches to said existing base surface or to the said base surface and the now closely underlying said roof or wall substructurals, the said top flange of said bracket provides the surface to which said new panels are attached, said lower flange and said top flange connected by said web.

3. A system as defined in claim 2, wherein flexure in said web provides for thermal expansion and contraction of said panels and absorbs shear forces of horizontal wind loads between the interconnected said existing panels and the new panels.

4. A system as defined in claim 1, further including performed apertures in said bracket for receiving the correct amount and size of said fastening means.

* * * * *